United States Patent [19]

Mitchell

[11] 4,058,937

[45] Nov. 22, 1977

[54] GRINDER ATTACHMENT FOR A LATHE

[75] Inventor: Wallace F. Mitchell, Libertyville, Ill.

[73] Assignee: Ammco Tools, Inc., North Chicago, Ill.

[21] Appl. No.: 652,496

[22] Filed: Jan. 26, 1976

[51] Int. Cl.[2] ..... B24B 19/26

[52] U.S. Cl. ..... 51/259; 51/273

[58] Field of Search ..... 51/259, 261, 270, 273, 51/168; 308/184; 74/574

[56] References Cited

U.S. PATENT DOCUMENTS

| | | | |
|---|---|---|---|
| 1,859,068 | 5/1932 | Beach | 51/259 |
| 2,232,733 | 2/1941 | Scarboro | 51/273 |
| 2,473,267 | 6/1949 | Wightman | 308/184 R X |
| 2,711,061 | 6/1955 | Fegert | 51/273 |
| 3,015,932 | 1/1962 | McCard | 308/184 R X |
| 3,103,069 | 9/1963 | Gary | 51/273 X |
| 3,568,962 | 3/1971 | Janssen | 308/184 R |
| 3,813,826 | 6/1974 | Bando | 51/168 |
| 3,824,745 | 7/1974 | Hutchins | 51/273 |
| 3,828,487 | 8/1974 | Mitchell | 51/259 |
| 3,836,215 | 9/1974 | Dopkin | 308/184 R |

*Primary Examiner*—Al Lawrence Smith
*Assistant Examiner*—Nicholas P. Godici
*Attorney, Agent, or Firm*—Edmond T. Patnaude

[57] ABSTRACT

A self-contained grinder attachment employs a rigid housing having an electric motor mounted thereon for driving both a grinding wheel and a blower which sucks air and loose particles entrained therein from the grinding area, the shaft on which the grinding wheel is mounted being connected to the housing by flexible and resilient connections thereby to isolate the grinding wheel from vibrations originating in the motor and in the lathe itself.

6 Claims, 4 Drawing Figures

GRINDER ATTACHMENT FOR A LATHE

The present invention relates in general to a grinder attachment for a lathe, and it relates in particular to a new and improved self-contained motor driven grinder attachment incorporating a suction cleaner and means for isolating the grinding wheel from vibrations originating in the lathe to which the attachement is mounted.

BACKGROUND OF THE INVENTION

The grinder attachment of the present invention is particularly well adapted for use as an attachment for lathes of the type disclosed in U.S. Pat. Nos. 2,891,435 and 3,245,292, and it constitutes an improvement of the grinder attachment disclosed in my own U.S. Pat. No. 3,828,487.

In order to provide a smooth finish on rotors such, for example, as brake drums, brake discs, clutch plates and fly wheels, it is desirable to finish grinding the brake surface to level off any hard spots in the rotor and to provide a uniformity in the final finish. For best results in many cases, the grinding operation should immediately follow the turning operation without removing the rotor from the lathe spindle.

The grinder attachment disclosed in my said patent has provided a substantial improvement in the quality of the finish obtained by the grinding operation. Several of the features of my prior grinder attachment are, therefore, incorporated in my new grinder attachment disclosed herein together with additional means for reducing the transfer of vibrations from the lathe to the grinding wheel.

Another problem associated with metal grinding operations has been the release of metal fines and small particles from the wheel itself into the atmosphere in the vicinity of the grinder. The grinder of the present invention incorporates novel means for preventing the release of such fines into the ambient air.

SUMMARY OF THE INVENTION

Briefly, there is provided in accordance with the present invention a self-contained electrically powered grinder for attachment to a brake service lathe or the like. The grinder of the present invention incorporates a housing carrying a drive motor, a grinding wheel and a suction cleaner which draws air and entrained particles from the grinding area and passes it through a combined filter and collector bag. The grinding wheel and the driveshaft to which it is mounted are isolated from vibrations originating in the lathe itself or in the drive motor of the grinder thereby to achieve a more smooth surface than has heretofore been provided with the prior art grinder attachments.

GENERAL DESCRIPTION OF THE DRAWINGS

Further objects and advantages and a better understanding of the present invention can be had by reference to the following detailed description, wherein.

DETAILED DESCRIPTION OF THE INVENTION

Figures 1, 2, 3:
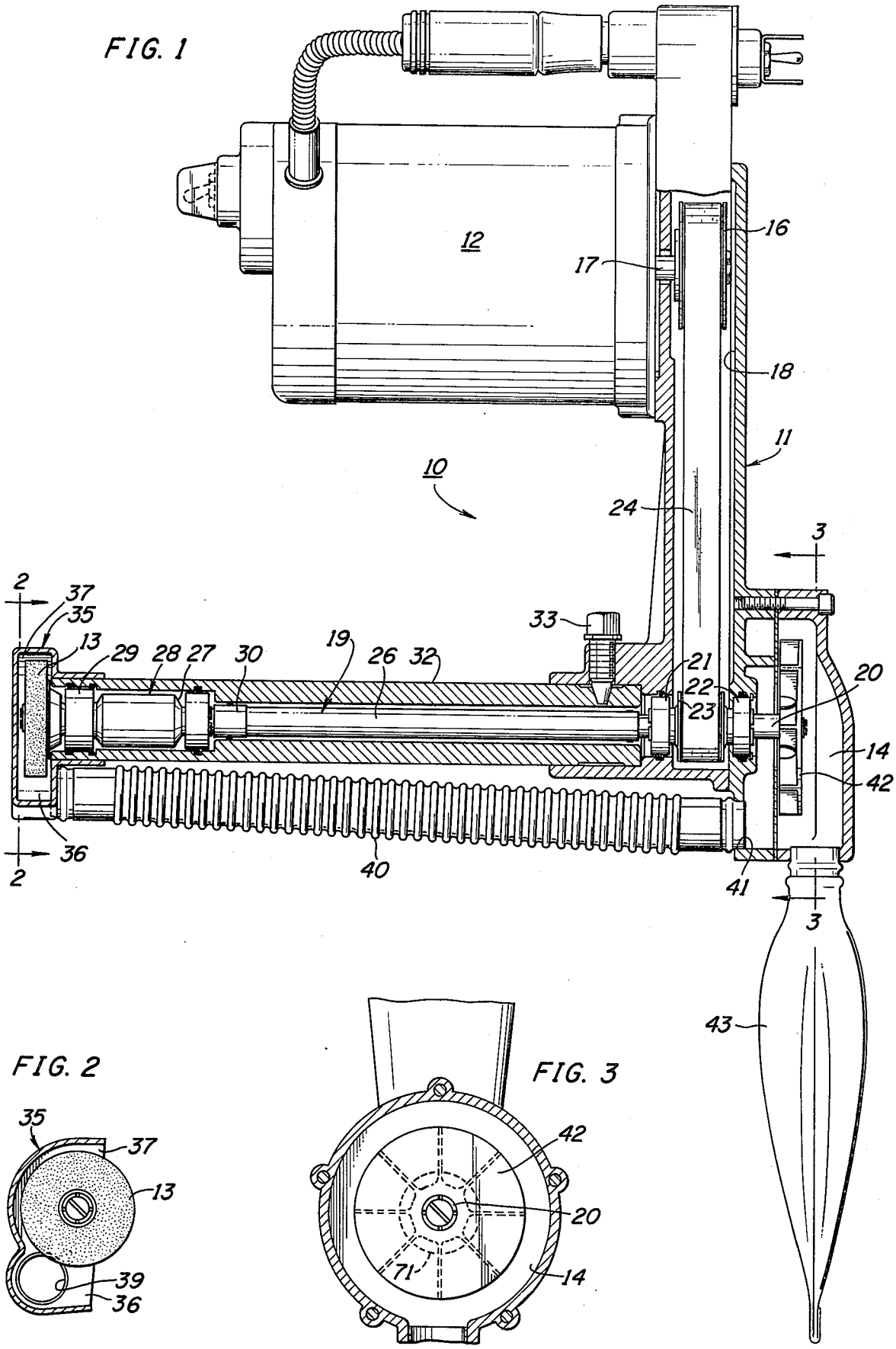
FIG. 1 is a partially sectioned view of a grinder attachment embodying the present invention.
FIG. 2 is a sectional view taken along the line 2—2 of FIG. 1 and particularly showing the suction head of the air cleaner feature of the present invention.
FIG. 3 is a sectional view taken along the line 3—3 of FIG. 1.

Referring now to FIG. 1, a grinder attachment 10 comprises a housing assembly 11 mounting an electric motor 12, a grinding wheel 13 and a suction cleaner assembly generally indicated at 14. The attachment 11 is adapted to be mounted on a lathe for use in grinding a workpiece carried by the spindle of the lathe.

A drive pulley 16 is keyed to the shaft 17 of the motor 12 and is located within a chamber 18 provided in the body of the housing 11. The grinding wheel 13 is mounted to the distal end of a driven shaft 19 which includes a first integral portion 20 journaled in the housing 11 by a pair of spaced apart ball bearings 21 and 22. The pulley 23 is integral with the shaft portion 20 and is located between the bearings 21 and 22, and a flexible, resilient drive belt 24 is connected between the pulleys 16 and 17.

The shaft 19 includes a central tubular portion 26 connected between the shaft portion 20 and a third shaft portion 27. The shaft portion 27 includes a large, solid, central inertia portion 28 disposed between a pair of ball bearings 29 and 30 which journal the shaft portion 27 in a tubular portion 32 of the housing 11. The portion 32 is removable from the remainder of the housing 11 and is adapted to be rigidly fixed thereto by means of a bolt 33.

As described in greater detail hereinafter, the grinding wheel 11 is fastened to the end of the driven shaft 19, and a rigid guard member 35 is mounted over the end of the housing portion 32. The guard 35, as best shown in FIG. 3, defines a cavity 36 which is open at one end 37 from which the grinding wheel 35 partially protrudes.

The guard 35 is configured so as to provide an enlarged portion of the cavity 36 adjacent to the periphery of the wheel. A hole 39 is provided in the guard 35 and a flexible conduit 40 is sealably connected to the guard 35 over the hole. The other end of the conduit 35 is sealably mounted in an opening 41 in the housing 11, and an impeller 42 mounted to the shaft 20 directs air into a porous flexible bag 43 which acts as a filter and collector. The metal pieces from the work piece, as well as the particles of the wheel which are released during the grinding operation, are thus removed from the area immediately adjacent the grinding area and collected in the dust bag 43.

Figure 4:
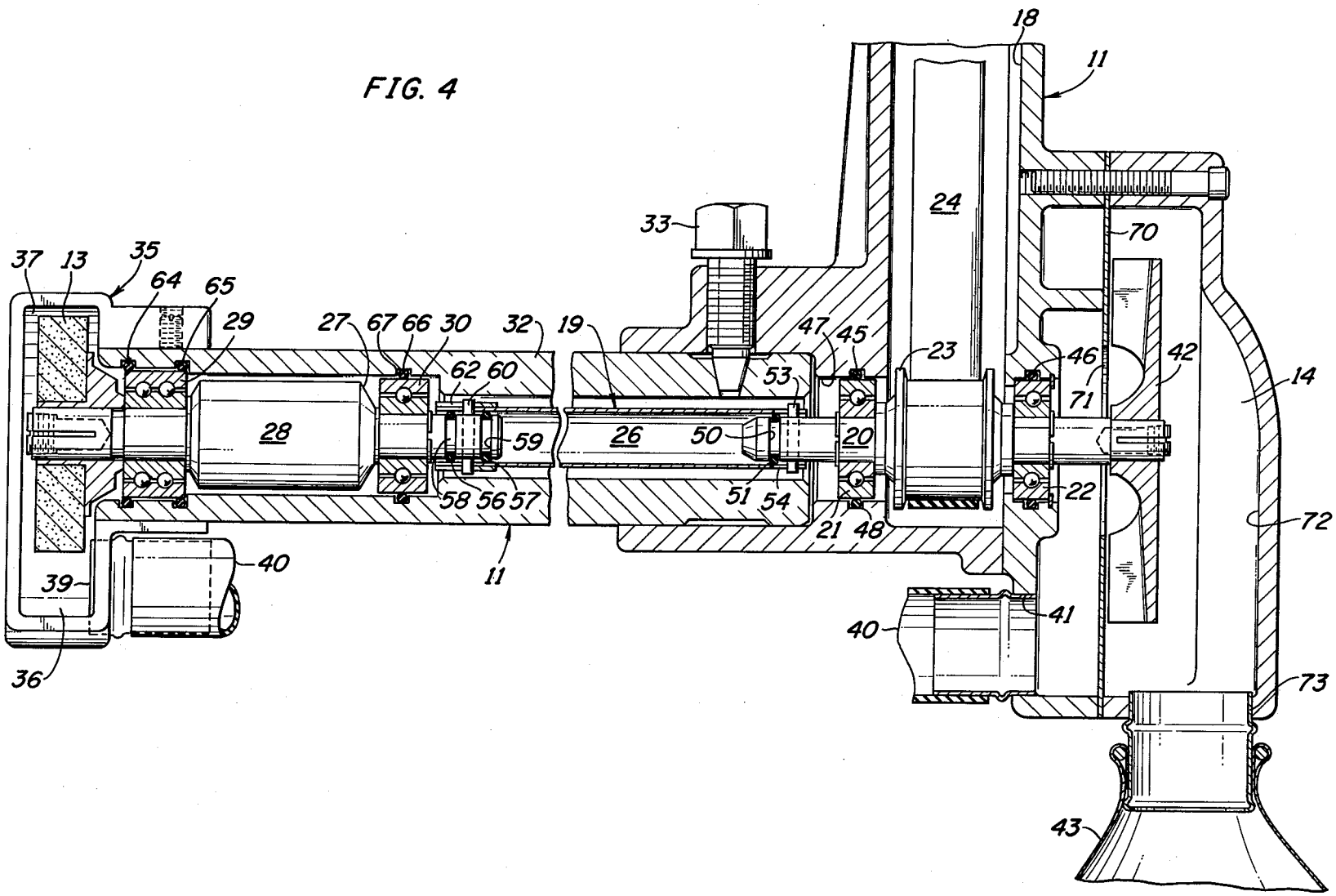
FIG. 4 is an enlarged, partially broken away, sectional view of the grinder attachment of FIG. 1.

Referring now to FIG. 4, it may be seen that each of the bearings 21 and 22 are mounted in the housing 11 by annular resilient members 45 and 46 respectively. The bearing 21 is disposed in a bore 47 in the housing 11 and has an outer diameter substantially less than the inner diameter of the bore 47.

The resilient annular member 45 which may be, for example, a resilient O-ring, is disposed in a groove 48 in the wall of the bore 47 and is compressed between the bottom of that groove and the outer circumference of the outer race of the bearing 21. The bearing 22 is similarly mounted to the housing by the resilient member 46.

The forwardly extending end of the shaft 20 is provided with an annular groove 50 in which is mounted a resilient O-ring 51. The O-ring 51 is compressed between the bottom of the groove 50 and the inner wall of the tubular shaft section 26. A roll pin 53 extends through a diametric hole in the shaft 20 and it is disposed in a slot 54 in the end of the tubular shaft section 26 to provide torque coupling between the shaft portions 20 and 26. Inasmuch as the OD of the shaft 20 where it extends into the shaft 26 is less than the ID of the shaft 26 relative axial movement between the two shaft sections is possible.

The shaft portion 27 at the forward end of the grinder attachment is similarly attached to the tubular shaft portion 26. To this end a pair of resilient O-rings 46 and 57 are mounted in spaced apart annular grooves 58 and 59 in the rearward end of the shaft 27 on opposite sides of a roll pin 60 which is press fitted in a diametric hole in the shaft section and extends into a slot 62 in the forward end of the shaft section 26 to provide torque coupling between the two shaft portions.

The ball bearings 29 and 30 are also mounted by resilient annular members to the housing portion 32. More particularly, the bearing 29 is mounted by a pair of resilient O-rings 64 and 65 respectively received in spaced apart annular grooves in the bore of the housing member 32. The bearing 30 is mounted by a resilient O-ring 66 also mounted in an annular groove 67 in the inner wall of the housing section 32.

It may thus be seen that the resilient mounting means for the shaft 19 isolates the shaft 19 and the grinding wheel 13 from vibrations which originate in the lathe itself. Any vibrations which are generated in the motor 12 and thus transferred to the housing are also prevented from being transmitted to the grinding wheel 13 since there is no rigid connection between the motor 12 and the grinding wheel or the shaft on which it is mounted.

Considering the suction blower feature of the present invention and referring to FIG. 4, an annular partition 70 having a central circular opening 71 is mounted inwardly of the impeller 42 which draws air through the opening 71 into the compartment 72 at the right hand side of the partition 70. The collector bag 43 is connected by a suitable coupling sleeve 73 to the chamber portion 72 whereby the air drawn through the flexible tube 40 from the cavity within the grinding guard 35 is directed into the dust collector bag 43.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. Grinding apparatus, comprising a rigid housing, a driven shaft having a first shaft portion and a second shaft portion, spaced apart bearing means journaling said first shaft portion in said housing, said second shaft portion being of tubular construction, said first shaft portion extending onto said second shaft portion resilient annular means compressed between said first and second shaft portions, a grinding wheel fixedly mounted on said shaft, a plurality of elastomeric rings respectively surrounding said bearing means and compressed between said housing and said bearing means, said rings providing the sole connection between said bearing means and said housing, a third driven shaft portion to which said grinding wheel is connected, said third driven shaft portion extending into said second shaft portion, other resilient annular means compressed between said second and third shaft portions, a driven pulley mounted to said first portion of said driven shaft, an electric motor mounted to said housing and having an output shaft, a drive pulley disposed on said output shaft, and a flexible, resilient belt drivingly connected between said pulleys.

2. Grinding apparatus according to claim 1, comprising a wheel guard partially enclosing said grinding wheel, an impeller mounted to said first shaft portion and located within a chamber in said housing, a conduit having one end opening into said guard adjacent said wheel and having the other end opening onto the suction side of said impeller, and a porous dust collector bag mounted over an opening in said housing on the pressure side of said impeller.

3. A grinding attachment according to claim 2, wherein said conduit comprises a flexible tube.

4. A grinding attachment according to claim 3, wherein said flexible tube is mounted at one end to said wheel guard.

5. A grinding attachment according to claim 2 wherein said housing comprises a first portion to one side of which said motor is mounted and a second tubular portion extending from said one side of said first portion and through which said second shaft portion extends.

6. Grinding apparatus, comprising a rigid housing a driven shaft having first, second and third shaft portions, bearing means respectively journaling said first and third portions in spaced apart alined relationship in said housing said second shaft portion being tubular and interposed between said first and third shaft portions, said first and third shaft portions respectively extending into the opposite ends of said second shaft portion, a plurality of resilient annular means respectively compressed between said first and third shaft portions and said second shaft portion, a grinding wheel mounted to said third shaft portion, a driven pulley mounted to said first shaft portion, an electric motor having an output shaft, said motor being mounted to said housing, a drive pulley mounted to said output shaft, and a flexible, resilient belt drivingly connected between said pulleys.

* * * * *